US008942943B2

(12) United States Patent
Telasang

(10) Patent No.: US 8,942,943 B2
(45) Date of Patent: Jan. 27, 2015

(54) DYNAMIC RANGE IMPROVEMENT FOR MASS SPECTROMETRY

(75) Inventor: Shankar Telasang, Fremont, CA (US)

(73) Assignee: Bruker Daltonics, Inc., Billerica, MA (US)

( * ) Notice: Subject to any disclaimer, the term of this patent is extended or adjusted under 35 U.S.C. 154(b) by 527 days.

(21) Appl. No.: 13/184,399

(22) Filed: Jul. 15, 2011

(65) Prior Publication Data

US 2013/0018621 A1 Jan. 17, 2013

(51) Int. Cl.
*H01J 49/26* (2006.01)
*H01J 49/00* (2006.01)

(52) U.S. Cl.
CPC ..... *H01J 49/0036* (2013.01)
USPC ..... 702/104

(58) Field of Classification Search
CPC ..... H01J 49/26
USPC ..... 702/104
See application file for complete search history.

(56) References Cited

U.S. PATENT DOCUMENTS

| | | | | |
|---|---|---|---|---|
| 4,490,806 | A * | 12/1984 | Enke et al. | 708/445 |
| 5,995,989 | A * | 11/1999 | Gedcke et al. | 708/300 |
| 6,836,742 | B2 | 12/2004 | Brekenfeld | |
| 7,047,144 | B2 * | 5/2006 | Steiner | 702/64 |
| 7,745,781 | B2 | 6/2010 | Steiner | |

FOREIGN PATENT DOCUMENTS

| | | | |
|---|---|---|---|
| GB | 2450959 | A | 1/2009 |
| WO | 2008008867 | A2 | 1/2008 |
| WO | 2012080443 | A1 | 6/2012 |

* cited by examiner

*Primary Examiner* — Jonathan C Teixeira Moffat
*Assistant Examiner* — Joseph J Yamamoto
(74) *Attorney, Agent, or Firm* — Robic, LLP

(57) ABSTRACT

Embodiments of the present disclosure provide methods of controlling an ion detector to minimize false peaks when utilizing extended dynamic range techniques. In one exemplary example, methods of controlling an ion detector are provided, comprising the steps of: determining an electronic baseline signal of the ion detector; receiving one or more ion input signals at the ion detector; comparing the ion input signal to the electronic baseline signal; and multiplying the ion input signal by a selected compensation factor when the ion input signal exceeds the electronic baseline signal.

9 Claims, 5 Drawing Sheets

DYNAMIC RANGE IMPROVEMENT FOR MASS SPECTROMETRY

TECHNICAL FIELD

The present disclosure relates generally to mass spectrometers having improved dynamic range. More specifically, embodiments of the present disclosure relate to methods of controlling an ion detector in a mass spectrometer to minimize or correct false peaks when utilizing extended dynamic range techniques.

BACKGROUND

Mass spectrometry (MS) is widely used as an analytical technique to provide qualitative and quantitative analysis of sample components. Generally, sample components are converted into ions which are resolved according to their mass-to-charge ratios. The ions are collected at an ion detector which converts the mass-resolved ion signals into output electrical signals. Typically, the ion detector includes an electron multiplier stage that applies voltage and thus provides gain to the output electrical signal of the ion detector. The output electrical signals are then processed to produce a mass spectrum.

In mass spectrometry it desirable for the spectrometer to operate over a wide range so that ions having very low intensities and ions having high ion intensities can be measured in the same mass scan. The measure of such performance is characterized as the dynamic range of the ion detector or mass spectrometer, and is generally defined as the range of output electrical current values across which the electron multiplier will provide a linear response. A wide dynamic range is difficult to achieve however, because for one voltage setting of the ion detector gain, either the large ion signals become saturated or the very low ion signals are not detected. Thus, the user would traditionally have to manually adjust the detector or multiplier gain for the two extreme conditions.

U.S. Pat. Nos. 7,047,144 and 7,745,781, the disclosures of both of which are hereby incorporated by reference in their entirety, describe techniques to address this problem by monitoring the ion intensities as they are detected and changing the multiplier voltage and thus the applied gain so that ions of all intensities are detected. In some examples, when the received ion signal intensity is very high, the multiplier voltage is decreased, and the ion signal is multiplied by a pre-tuned compensation factor or gain in order to compensate for the decrease in the voltage multiplier. When the received ion signal intensity is too low, the multiplier voltage is increased and applied to the ion signal to adjust the ion intensity accordingly. With this method, both sides of the extremes in received ion signal intensities are compensated for, which increases the dynamic range of the ion detector (sometimes also referred to as "extended dynamic range" or "EDR"). Because of dynamic range, when we have high ion intensity, the multiplier voltage is reduced which in turn increases the compensation factor used to multiply the signal.

While the methods described in U.S. Pat. Nos. 7,047,144 and 7,745,781 are an advance in the art, a significant limitation of the prior art is that the method does not differentiate between the actual ion signal and the electronic baseline signal of the ion detector. Specifically, the same compensation factor is used to compute the height of all signals, both the ion signals and the electronic baseline signal. The electronic baseline signal is independent of the ion signals, and when extended dynamic range is applied to all of the signals in a spectrum, meaning that as all of the signals are multiplied up and down by a selected compensation factor due to the variations in large and small peak intensities of the ion signals, the baseline signal value is also multiplied up and down which may cause the baseline signal to appear as one or more false peaks when the output signals are processed. FIG. 1 depicts such a problem. In FIG. 1 a mass chromatograph produced by prior art methods of applying extended dynamic range techniques to the ion detector is illustrated. As shown, a real peak 102 is present, however since the baseline signal is also multiplied by the selected compensation factor, a number of false peaks 104, 106 and 108 are produced. Thus, when the output signals are processed and a chromatograph of different masses is produced you will still see peak(s) from the baseline signal, irrespective of whether the ion actually present in the sample or not.

False peaks in the resulting mass chromatograph are a significant problem for the industry. False peaks can be misinterpreted as real ion signals leading to misidentification of sample constituents and erroneous results. Such problems limit the use and effectiveness of techniques for improving sensitivity and extending the dynamic range of the instruments. Accordingly, additional developments and improvements are greatly needed.

SUMMARY

Broadly, the present disclosure relates to correction of false peaks in mass spectrometry. More specifically, embodiments of the present disclosure relate to methods of controlling an ion detector in a mass spectrometry system to minimize or correct false peaks when utilizing extended dynamic range techniques.

The inventor has discovered that the electronic baseline signal of the mass spectrometer system can contribute to false peaks in the resultant mass spectroscopy spectrum when a compensation factor is adjusted up and down in techniques used to extend the dynamic range (often referred to as "extended dynamic range" or "EDR") of the ion detector. The inventor has invented methods that address this problem of the prior art by separating the electronic baseline signal from the actual ion signals when applying EDR, using the observation that the baseline is independent of actual signal value. Thus, when the compensation factor applied to the ion detector is adjusted, the baseline value does not change, and false peaks are minimized.

In another embodiment, methods of minimizing false peaks in a mass spectrometer system are described, comprising the steps of: initially measuring an average baseline electronic signal characteristic of the mass spectrometer. A threshold value is then determined. Generally the threshold is set at a value above the average baseline electronic signal and the standard deviation of the average baseline electronic signal. One or more ion input signals are then received at the ion detector. These ion input signals are compared to the threshold value. The ion input values that exceed the threshold value are then multiplied by a selected compensation factor. The selected compensation factor may be predetermined, or may be determined dynamically using extended dynamic range techniques.

In an exemplary embodiment, methods of increasing dynamic range in an ion detector are described, characterized in that gain is adjusted based on the intensity of received ion signals without a corresponding adjustment in the baseline electronic signal.

In further embodiments, methods of controlling an ion detector in a mass spectrometry system are described, comprising the steps of: determining an electronic baseline signal of the mass spectrometry system; receiving one or more ion input signals at the ion detector; comparing the ion input signal to the electronic baseline signal; and multiplying the ion input signal by a selected compensation factor when the ion input signal exceeds the electronic baseline signal. In some embodiments, the selected compensation factor is determined dynamically based on the intensity of at least one of the received ion signals. The selected compensation factor may be adjusted by adjusting a control voltage applied to the ion detector.

In another aspect, a computer readable medium including software for controlling an ion detector of a mass spectrometer is provided where the computer readable memory comprises logic configured for implementing the steps described above.

BRIEF DESCRIPTION OF THE DRAWINGS

The foregoing and other aspects of the present disclosure will be apparent upon consideration of the following detailed description, taken in conjunction with the accompanying drawings, in which like reference characters refer to like parts throughout, and in which.

DETAILED DESCRIPTION OF EXAMPLE EMBODIMENTS

Example embodiments are described herein in the context of a mass spectrometer and methods of controlling an ion detector. Those of ordinary skill in the art will realize that the following description is illustrative only and is not intended to be in any way limiting. Other embodiments will readily suggest themselves to such skilled persons having the benefit of this disclosure. Reference will now be made in detail to various implementations of the example embodiments as illustrated in the accompanying drawings. The same reference indicators will be used to the extent possible throughout the drawings and the following description to refer to the same or like items.

In the interest of clarity, not all of the routine features of the various implementations disclosed herein are shown and described. It will be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In this description, the use of the singular includes the plural unless specifically stated otherwise. Also, the use of "or" means "and/or" unless stated otherwise. Similarly, "comprise," "comprises," "comprising," "include," "includes" "including" "has" and "having" are not intended to be limiting.

Figure 1:
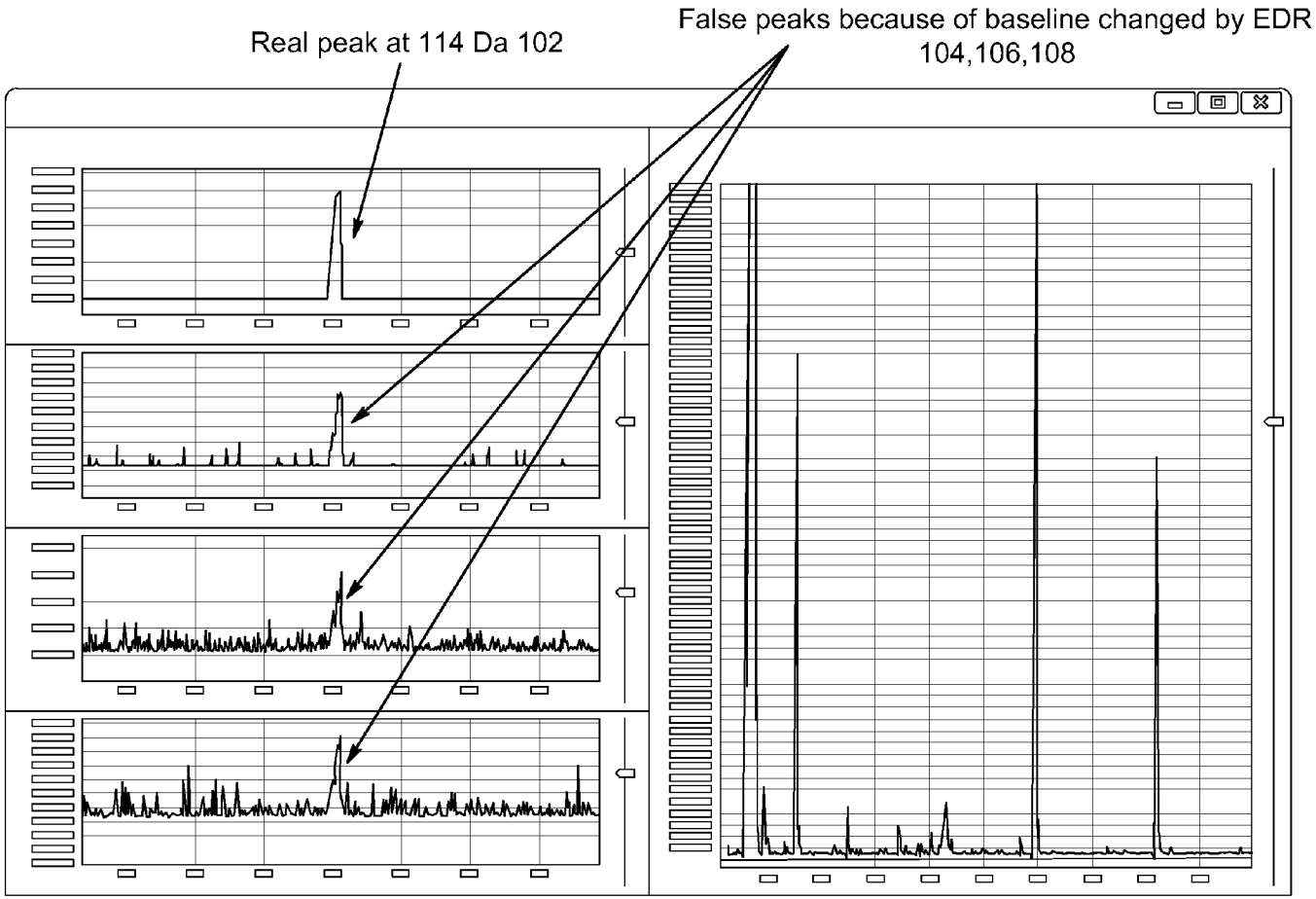
FIG. 1 (PRIOR ART)
FIG. 1 shows a mass chromatograph produced by prior art methods of applying extended dynamic range techniques to a mass spectrometer.
Figure 2:
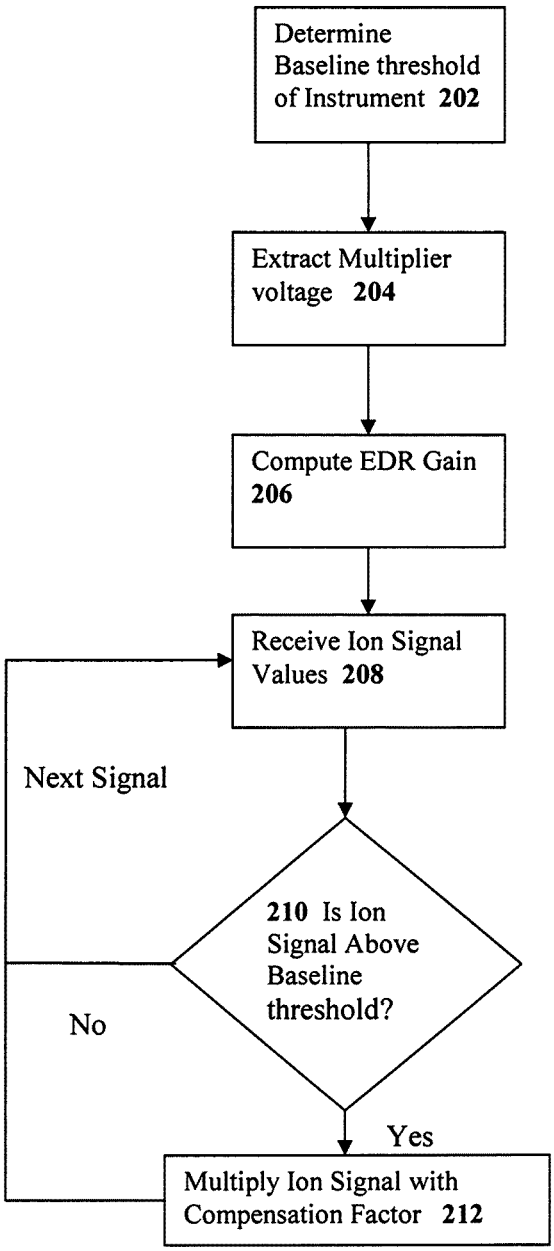
FIG. 2 illustrates one example implementation of the method according to the present disclosure.

FIG. 2 is a flowchart illustrating one example of a specific implementation of the present disclosure. The methods described herein may generally be practiced on mass spectrometers or any configuration, such as for example, without limitation, the mass spectrometers shown and described in U.S. Pat. Nos. 7,047,144 and 7,745,781, the disclosures of both of which are hereby incorporated by reference in their entirety. Another example of a mass spectrometer, again without limitation, suitable to carry out the methods of the present disclosure is described in pending patent application Ser. No. 13/089,980 filed on Apr. 19, 2011, the disclosure of which is hereby incorporated by reference in its entirety.

The methods described in FIG. 2 may be implemented by hardware (such as in analog or digital circuitry), software, and/or computer readable medium. Preferably the methods are implemented by software. Computer readable medium may be any medium known in the art and includes, but is not limited to, signal-bearing medium, electronic, magnetic, electromagnetic, optical, semiconductor or infrared device, apparatus, or system.

Referring to FIG. 2, a baseline threshold of the instrument is determined at step 202. The baseline threshold is based on the baseline electronic signal of the mass spectrometer. The baseline electronic signal (also referred to simply as "baseline") is broadly defined as the signal level of the mass spectrometer when there is no ion signal present. In theory, since there is no ion signal present, this signal value should be zero. However, in practice there is usually electronic noise and thus there will be some signal level present when the device is powered on, even when there are no ion signals being received.

To determine the baseline electronic signal, the mass spectrometer is powered on and the signal level of the spectrometer when no ion signals are present is measured. It is preferred that the baseline electronic signal is a positive signal, so an offset is applied to the signal level if needed so that the baseline electronic signal is always above zero. So in this instance, the baseline electronic signal that is measured and/or processed is in effect an offset baseline.

The baseline threshold value is generally set at a value above the average baseline electronic signal and the standard deviation of the average baseline electronic signal. In one example, to determine the baseline threshold value, a plurality of measurements of the electronic baseline signal are taken, and the average is calculated as well as the maximum and minimum signal values. The Baseline threshold value is then determined as:

$$\text{Baseline threshold value} = \text{baseline}_{average} + (\text{baseline}_{max} - \text{baseline}_{min}) \quad (1)$$

where $\text{baseline}_{average}$ is the average of the plurality of baseline electronic signals, $\text{baseline}_{max}$ is the maximum baseline electronic signal measured and $\text{baseline}_{min}$ is the minimum baseline electronic signal measured;

As discussed above, it desirable for the spectrometer to operate over a wide range so that ions having very low intensities and ions having high ion intensities can be measured in the same mass scan. Extended dynamic range (EDR) is carried out at steps 204 and 206 to compute a compensation factor based on extracted multiplier voltage values that will then be applied selectively to certain of the received ion signals at step 212 according to the inventive method. In the example implementation shown in FIG. 2, multiplier voltages are extracted at step 204 and a selected compensation factor is computed at step 206 preferably using the extended dynamic range (EDR) techniques described in detail in U.S. Pat. Nos. 7,047,144 and 7,745,781, the disclosures of both of which are hereby incorporated by reference in their entirety. The term "multiplier voltage" refers to the control or drive voltage applied to the electron multiplier of the ion detector.

First, an initial multiplier voltage is established or extracted or may be set based on an initial mass scan, or by other methods, as described in U.S. Pat. Nos. 7,047,144 and 7,745,781. In one example, a look-up table or calibration curve having compensation factor verses multiplier control voltage values as described in U.S. Pat. No. 7,047,144 is then used to determine the selected compensation factor based on the extracted multiplier voltage.

Alternatively, the compensation factor may be computed dynamically according to U.S. Pat. No. 7,745,781. In this instance, an initial multiplier voltage and corresponding compensation factor are computed at steps 204 and 206. Thereafter, the multiplier voltage applied to the ion detector may be adjusted dynamically. For example, drive voltage to electron multiplier of the ion detector is decreased in response to an increase in the intensity of one received ion input signal, and increased in response to a decrease in the intensity of another received ion input signal.

One or more ion input signals are received at the ion detector and extracted at step 208. Each ion input signal is compared to the baseline threshold value (also sometimes called the "baseline") at step 210. If the ion input signal value exceeds the baseline threshold value, the ion input signal is multiplied at step 212 with the compensation factor computed in step 206. If the ion input signal value is below the baseline threshold value, then that signal is excluded from multiplier step 212, and instead step 208 is repeated. That is, the next ion signal is extracted at step 208 and the inquiry is made at step 210 as to whether the next ion signal is above the baseline threshold value. The process sequence of steps 208, 210 and 212 are repeated until all ion signals in a scan are evaluated. Thus, signals below the baseline threshold value are excluded from the compensation correction, and thus they are not increased or decreased.

Figures 3A, 3B:
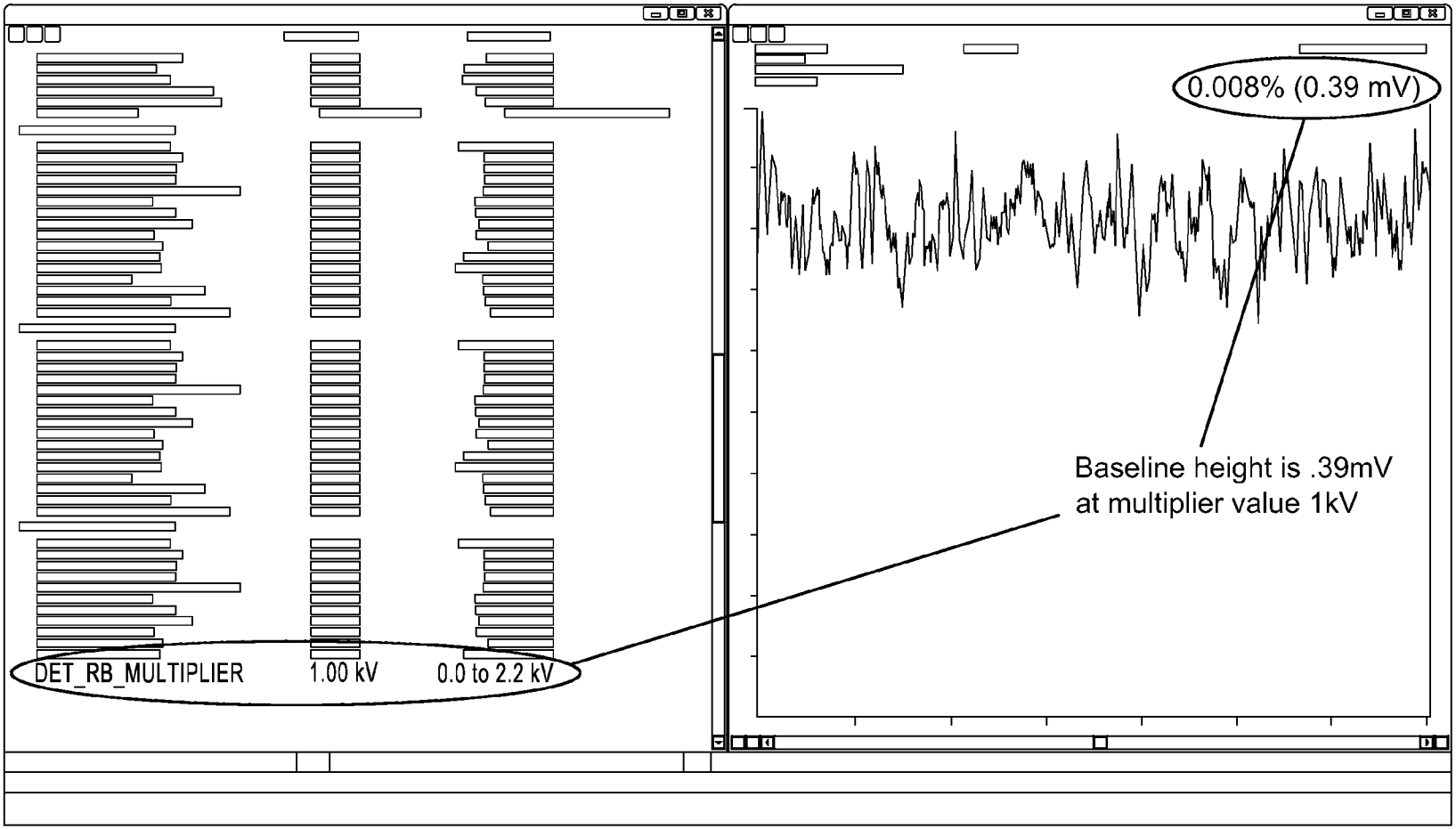
FIGS. 3A and 3B show voltage multiplier data and the resulting electronic baseline signal, respectively, at a voltage multiplier of 1 kV applied to the gain of the ion detector.
Figures 4A, 4B:
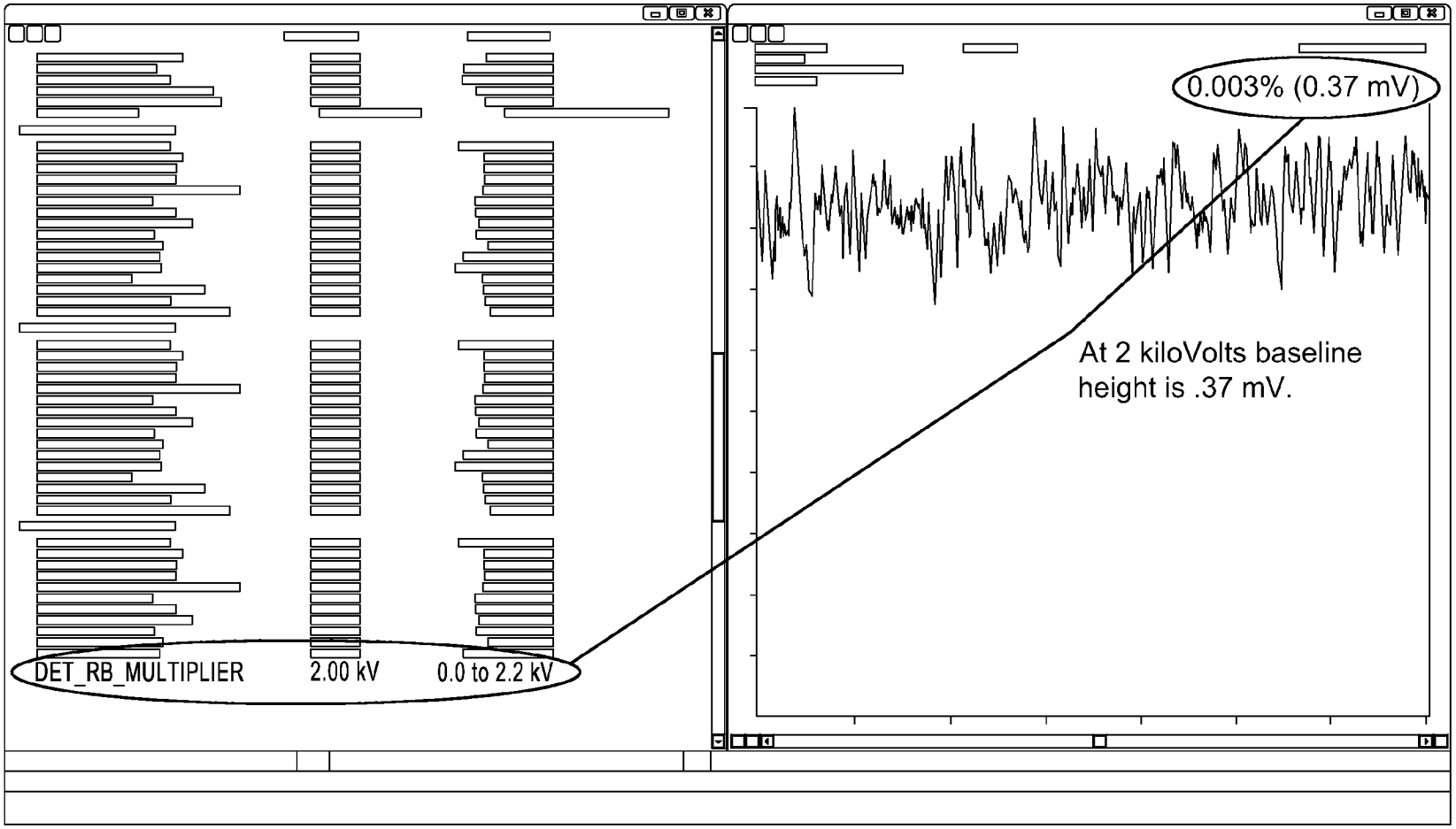
FIGS. 4A and 4B show voltage multiplier data and the resulting electronic baseline signal, respectively, showing that the electronic baseline signal does not appreciably change when the voltage multiplier is increased to 2 kV applied to the gain of the ion detector.

Experiments were conducted wherein the multiplier voltage and corresponding compensation factor were varied and applied to various mass scans. FIG. 3A shows various instrument values, including voltage multiplier data for one experiment. FIG. 3B shows the resulting electronic baseline signal when a voltage multiplier of 1 kV is applied to the gain of the ion detector. Next, the voltage multiplier was increased to 2 kV as shown in FIG. 4A, and the resulting electronic baseline signal is illustrated in FIG. 4B. Comparing FIGS. 3A and 3B with FIGS. 4A and 4B it is shown that the electronic baseline signal does not appreciably change when the voltage multiplier is changed from 1 kV to 2 kV.

Figure 5:
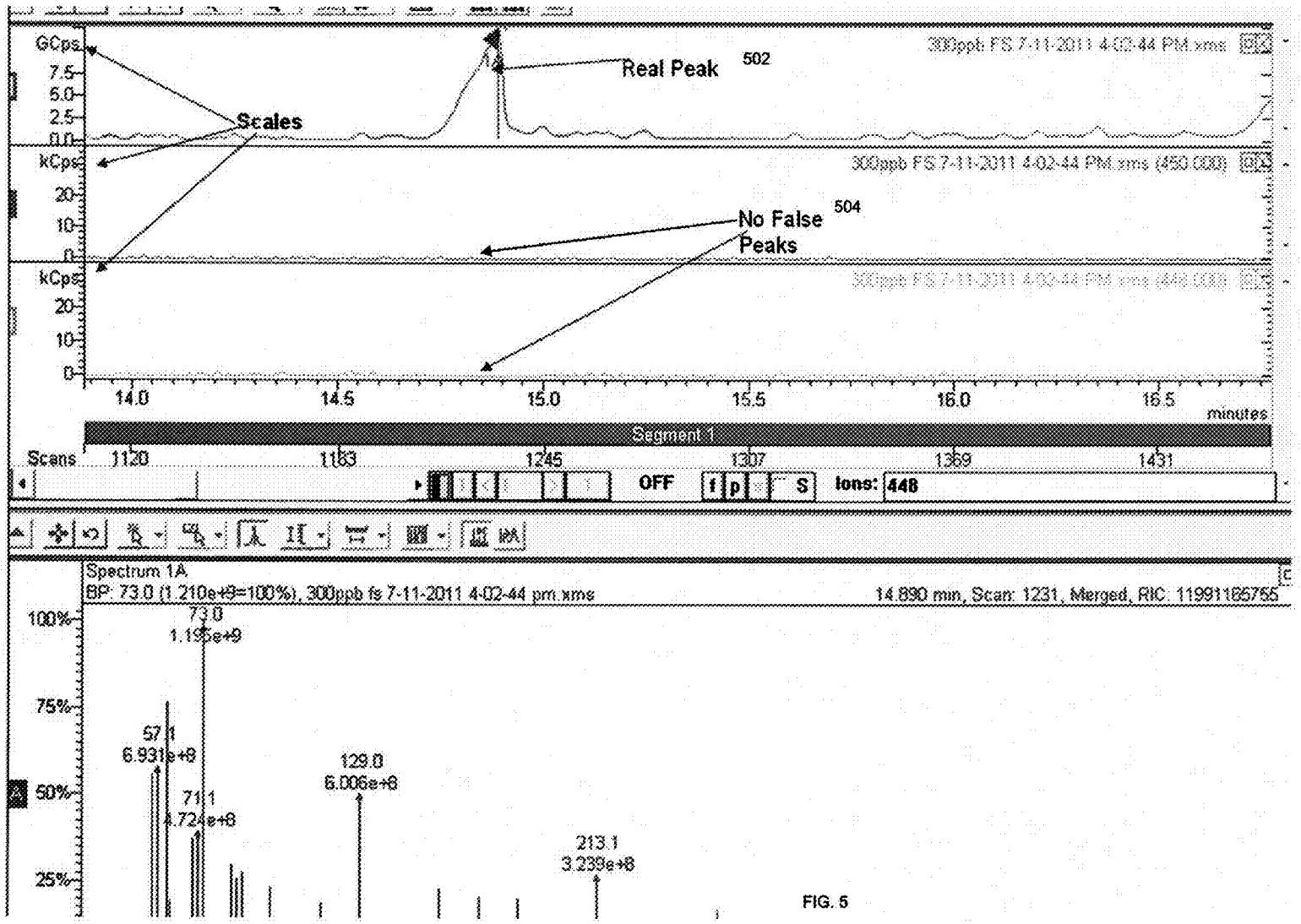
FIG. 5 is a mass chromatograph produced by methods of the present disclosure showing that false peaks are substantially eliminated in the resultant spectrum.

Referring to FIG. 5, a mass chromatograph produced by methods of the present invention is illustrated. Specifically, a full mass scan was run having a mass range of 50 to 450. A triple quad type mass spectrometer was used with an EI source. The sample tested was vegetable extract spiked with pesticide standards. The scan produced a real peak at 502. Of particular advantage, false peaks are substantially eliminated in the resultant spectrum. In fact, the spectrum shows no false peaks 504 where they would otherwise have been present had the inventive method not been applied.

The foregoing methods and description are intended to be illustrative and are not intended to limit the disclosure in any way. While certain embodiments and applications have been shown and described, it may be apparent to those skilled in the art having the benefit of this disclosure and the teachings provided herein, that other modifications or approaches are possible without departing from the inventive concepts disclosed herein. The invention, therefore, is not to be restricted.

I claim:

1. A method of minimizing false peaks in a mass spectrometer having an ion detector that uses extended dynamic range techniques in forming a detector output signal, the method comprising the steps of:

initially measuring a plurality of baseline electronic signals characteristic of the mass spectrometer;

setting a Baseline threshold value equal to one of:

$$\text{Baseline threshold value}=\text{baseline}_{average}+(\text{baseline}_{max}-\text{baseline}_{min}) \quad \text{(i)}$$

where $\text{baseline}_{average}$ is an average of the plurality of baseline electronic signals, $\text{baseline}_{max}$ is the maximum baseline electronic signal measured and $\text{baseline}_{min}$ is the minimum baseline electronic signal measured, and $$\text{Baseline threshold value}=\text{baseline}_{average}+\text{SD} \quad \text{(ii)}$$

where $\text{baseline}_{average}$ is an average of the plurality of baseline electronic signals and SD is a standard deviation of the average of the plurality of baseline electronic signals;

receiving one or more ion input signals at the ion detector;

comparing each ion input signal to the Baseline threshold value; and multiplying each ion input signal by a selected compensation factor when the ion input signal exceeds the Baseline threshold value while excluding those ion input signals which are below the Baseline threshold value from the multiplication, such that the output signal includes ion input signals that have been multiplied by the compensation factor and ion input signals that have not been multiplied by the compensation factor.

2. The method of claim 1 wherein the selected compensation factor is determined based on the intensity of at least one of the received ion signals.

3. The method of claim 1 further comprising: adjusting the selected compensation factor by adjusting a control voltage applied to the ion detector in response to the intensity of the one or more ion input signals.

4. The method of claim 1 further comprising establishing or extracting a multiplier voltage and determining the selected compensation factor from a look-up table or calibration curve having compensation factor verses multiplier voltage values.

5. A non-transitory computer readable medium including software for controlling an ion detector of a mass spectrometer, the computer readable memory comprising logic configured for implementing the steps of:

initially measuring a plurality of baseline electronic signals characteristic of the mass spectrometer;

setting a Baseline threshold value equal to one of:

$$\text{Baseline threshold value}=\text{baseline}_{average}+(\text{baseline}_{max}-\text{baseline}_{min}) \quad \text{(i)}$$

where $\text{baseline}_{average}$ is an average of the plurality of baseline electronic signals, $\text{baseline}_{max}$ is the maximum baseline electronic signal measured and $\text{baseline}_{min}$ is the minimum baseline electronic signal measured, and $$\text{Baseline threshold value}=\text{baseline}_{average}+\text{SD} \quad \text{(ii)}$$

where $baseline_{average}$ is an average of the plurality of baseline electronic signals and SD is a standard deviation of the average of the plurality of baseline electronic signals;

receiving one or more ion signals at the ion detector;

comparing each ion input signal to the Baseline threshold value; and multiplying each ion input signal by a selected compensation factor when the ion input signal exceeds the Baseline threshold value while excluding those ion input signals which are below the Baseline threshold value from the multiplication such that an output signal of the detector includes ion input signals that have been multiplied by the compensation factor and ion input signals that have not been multiplied by the compensation factor.

6. The non-transitory computer readable medium of claim 5 further comprising logic configured for implementing the step of: establishing or extracting a multiplier voltage and determining the selected compensation factor from a look-up table or calibration curve having compensation factor verses multiplier voltage values.

7. The non-transitory computer readable medium of claim 5 wherein the selected compensation factor is determined based on the intensity of at least one of the received ion signals.

8. The non-transitory computer readable medium of claim 5 wherein the steps implemented by the logic of the computer readable memory further comprise adjusting the selected compensation factor by adjusting a control voltage applied to the ion detector in response to the intensity of the one or more ion input signals.

9. The method of claim 5 wherein the steps implemented by the logic of the computer readable memory further comprise establishing or extracting a multiplier voltage and determining the selected compensation factor from a look-up table or calibration curve having compensation factor verses multiplier voltage values.

* * * * *